US010752030B2

(12) United States Patent
Hwang et al.

(10) Patent No.: US 10,752,030 B2
(45) Date of Patent: Aug. 25, 2020

(54) PRINTER AND PRINTING METHOD

(71) Applicant: BIXOLON Co., Ltd., Seongnam-si (KR)

(72) Inventors: Junho Hwang, Suwon-si (KR); Gihwan Ahn, Seongnam-si (KR)

(73) Assignee: BIXOLON CO., LTD., Seongnam-si (KR)

( * ) Notice: Subject to any disclaimer, the term of this patent is extended or adjusted under 35 U.S.C. 154(b) by 0 days.

(21) Appl. No.: 16/389,829

(22) Filed: Apr. 19, 2019

(65) Prior Publication Data

US 2019/0248162 A1 Aug. 15, 2019

Related U.S. Application Data

(63) Continuation of application No. PCT/KR2017/011702, filed on Oct. 20, 2017.

(30) Foreign Application Priority Data

Oct. 20, 2016 (KR) ..... 10-2016-0136467

(51) Int. Cl.

| | |
|---|---|
| ***B41J 11/46*** | (2006.01) |
| ***B41J 11/66*** | (2006.01) |
| ***B41J 3/407*** | (2006.01) |
| ***B41J 29/38*** | (2006.01) |
| ***B41J 2/01*** | (2006.01) |
| ***G03G 15/00*** | (2006.01) |
| ***B41J 11/42*** | (2006.01) |
| ***B41J 11/00*** | (2006.01) |

(52) U.S. Cl.

CPC ..... *B41J 11/46* (2013.01); *B41J 2/01* (2013.01); *B41J 3/407* (2013.01); *B41J 11/00* (2013.01); *B41J 11/42* (2013.01); *B41J 11/663* (2013.01); *B41J 29/38* (2013.01); *G03G 15/00* (2013.01)

(58) Field of Classification Search

CPC ..... B41J 11/46; B41J 2/01; B41J 3/407; B41J 11/00; B41J 11/42; B41J 11/663; B41J 29/38; G03G 15/00

See application file for complete search history.

(56) References Cited

U.S. PATENT DOCUMENTS

| | | | | |
|---|---|---|---|---|
| 8,436,734 | B2 | 5/2013 | Kato et al. | |
| 2010/0078870 | A1* | 4/2010 | Fellingham | B41J 2/2132 271/8.1 |
| 2016/0027222 | A1 | 1/2016 | Kurihara | |
| 2018/0354277 | A1* | 12/2018 | Runckel | B41J 2/04586 |

* cited by examiner

*Primary Examiner* — Lamson D Nguyen

(74) *Attorney, Agent, or Firm* — KORUS Patent, LLC; Seong Il Jeong

(57) ABSTRACT

A printer and a printing method are proposed. The printer and the printing method include transferring printing paper until a cutting target marker first disposed after a location at which the printing of a unit output has been completed based on the transfer direction of the printing paper reaches a cutting position, and cutting the corresponding location when the printing paper is transferred until the cutting target marker reaches the cutting position.

14 Claims, 6 Drawing Sheets

PRINTER AND PRINTING METHOD

TECHNICAL FIELD

Embodiments disclosed in the present specification relate to a printer and a printing method, and more specifically to a printer and a printing method that are capable of printing outputs having different printing lengths without changing printing paper.

BACKGROUND ART

A printer is an output device that prints information, processed by an information processing device, on a printing medium in a form that can be seen with the eyes of a human. Such printers are divided into various types according to their printing method and application, and are being widely used.

Accordingly, printing media used in printers, i.e., printer paper, are also configured in various forms according to printing methods or the uses of printers. For example, the paper used in thermal printers may be thermal printing paper that reacts with heat, and the paper used in inkjet printers may be general paper. Furthermore, office printers may use paper cut in a standardized size, e.g., an A4 size, as printing media, whereas portable printers may use long strip paper wound in a roll as printing media.

In particular, printers for label printing can be used along with printing paper for a label coated with an adhesive on the rear surface thereof, which is opposite to the printing surface thereof. Printing paper for a label may be subdivided into a type with release paper and a type without release paper.

In a printer that performs printing on such printing paper for a label, printing paper marked with markers at predetermined intervals may be used to allow the printing paper to be accurately cut in accordance with a printing position and length after printing has been performed to a predetermined length. In this case, the printer is provided with a sensor configured to recognize the locations of markers, and identifies the locations of the markers by means of the sensor. Accordingly, the printer performs printing between a marker and a marker, and can output a label having a printing length corresponding to the interval between markers by cutting a position where a marker is formed.

However, in this conventional technology, only a label having a length corresponding to the interval between the markers can be output, and a problem arises in that it is difficult to output a label having a length exceeding the interval between the markers.

Accordingly, inefficiency occurs in that a plurality of types of printing paper marked with markers at different intervals is required according to the printing lengths of labels.

Furthermore, when labels have different printing lengths, burdensomeness arises in that the printing medium of a printer must be replaced with a different type of printing paper having markers at a different interval each time.

Therefore, there is a need for a technology capable of overcoming the above-described problems.

Meanwhile, the above-described background technology corresponds to technical information that has been possessed by the present inventor in order to contrive the present invention or which has been acquired in the process of contriving the present invention, and can not necessarily be regarded as well-known technology which had been known to the public prior to the filing of the present invention.

DISCLOSURE

Technical Problem

An object of embodiments disclosed in the present specification is to propose a printer and printing method that are capable of outputting labels having various printing lengths regardless of the interval between markers indicated on printing paper.

An object of embodiments disclosed in the present specification is to propose a printer and printing method that are capable of outputting even a label having a length exceeding the interval at which markers are indicated on printing paper.

Furthermore, an object of embodiments disclosed in the present specification is to propose a printer and printing method that are capable of successively printing labels having different printing lengths without changing printing paper.

Furthermore, an object of embodiments disclosed in the present specification is to propose a printer and printing method that are capable of accurately cutting paper according to a printing position and length while outputting labels having different printing lengths.

Technical Solution

As a technical solution for accomplishing the above objects, according to one embodiment, there may be provided a printer for printing individual unit outputs while transferring printing paper on which a plurality of markers is repeatedly arranged in a transfer direction, the printer including: a printing unit that performs printing on the printing paper; a paper transfer unit that transfers the printing paper; a marker detection unit that detects the markers arranged on the printing paper; a cutting unit that cuts the printing paper at a cutting position; and a control unit that, when the printing unit prints one of the unit outputs on the printing paper, causes the paper transfer unit to transfer the printing paper until a cutting target marker first disposed after a location at which the printing of the unit output has been completed based on a transfer direction of the printing paper reaches the cutting position of the cutting unit.

Furthermore, as a technical solution for accomplishing the above objects, according to one embodiment, there may be provided a printing method that is performed by a printer for printing individual unit outputs while transferring printing paper on which a plurality of markers is repeatedly arranged in a transfer direction, the printing method including: when the printing of one of the unit outputs on the printing paper starts, counting a transfer distance over which the printing paper has been transferred during the printing of the unit output; when one of the markers arranged on the printing paper is detected, initializing the counted transfer distance, and recounting a transfer distance; and, when the printing of the unit output has been completed, calculating the transfer target distance of the printing paper based on the counted transfer distance, and transferring the printing paper by the calculated transfer target distance.

Moreover, as a technical solution for accomplishing the above objects, according to one embodiment, there may be provided a printing method that is performed by a printer for printing individual unit outputs while transferring printing paper on which a plurality of markers is repeatedly arranged in a transfer direction, the printing method including: when the printing of one of the unit outputs on the printing paper starts, counting a transfer distance over which the printing paper has been transferred during the printing of the unit output; when the counted transfer distance reaches a value obtained by subtracting a preset first predetermined distance from the expected printing length of the unit output, starting the detection of one of the markers arranged on the printing paper; when one of the markers arranged on the printing paper is detected after the starting of detection of one of the markers, initializing the counted transfer distance, and recounting a transfer distance; and transferring the printing paper until the transfer distance recounted after the initialization reaches a preset second predetermined distance.

Advantageous Effects

According to any one of the above-described technical solutions of the present invention, there may be proposed a printer and a printing method that are capable of outputting labels having various printing lengths regardless of the interval between markers indicated on printing paper.

Furthermore, according to any one of the above-described technical solutions of the present invention, there may be proposed a printer and printing method that are capable of outputting even a label having a length exceeding the interval at which markers are indicated on printing paper.

Furthermore, according to any one of the above-described technical solutions of the present invention, there may be proposed a printer and printing method that are capable of successively printing labels having different printing lengths without changing printing paper.

Moreover, according to any one of the above-described technical solutions of the present invention, there may be proposed a printer and printing method that are capable of accurately cutting paper according to a printing position and length while outputting labels having different printing lengths.

The effects that can be acquired by the disclosed embodiments are not limited to the above-described effects, and other effects that have not been described will be clearly understood by those having ordinary knowledge in the art, to which the disclosed embodiments pertain, from the following description.

MODE FOR INVENTION

Various embodiments will be described in detail below with reference to the accompanying drawings. The following embodiments may be modified and practiced in various different forms. In order to more clearly describe the features of the embodiments, detailed descriptions of items well known to those having ordinary knowledge in the art to which the embodiments pertain will be omitted. Furthermore, parts unrelated to descriptions of the embodiments will be omitted in the accompanying drawings, and similar reference symbols will be assigned to similar parts throughout the specification.

Throughout the specification, when a component is described as being "connected to another component," this includes not only a case where they are "directly connected to each other" but also a case where they are "connected to each other with a third component interposed therebetween." Furthermore, when a component is described as "including" another component, this means that a third component is not excluded but may be further included, unless particularly described to the contrary.

Embodiments of the present invention will be described in detail below with reference to the accompanying drawings.

Figure 1:
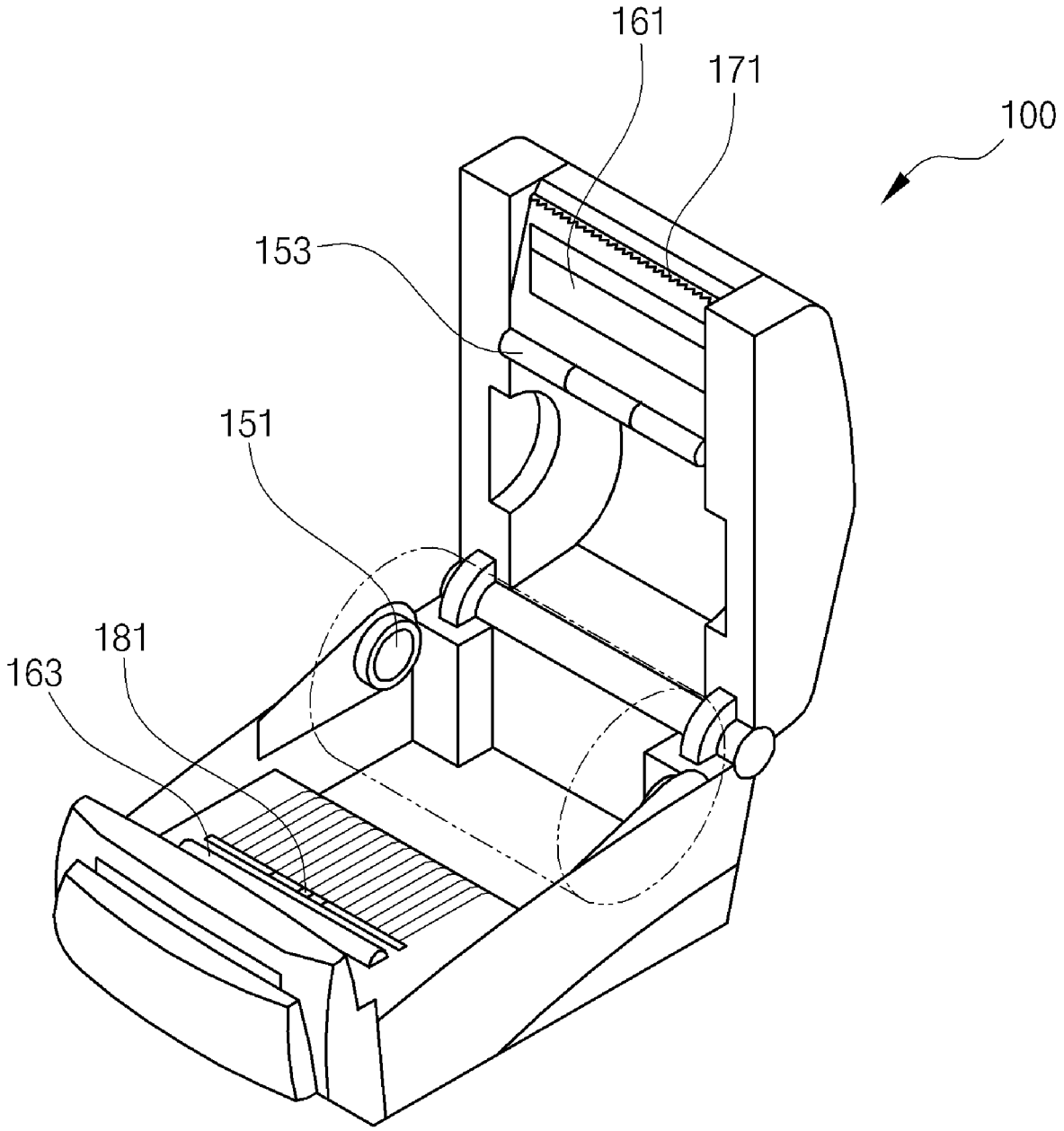
FIG. 1 is a perspective view of a printer according to one embodiment.
Figure 2:
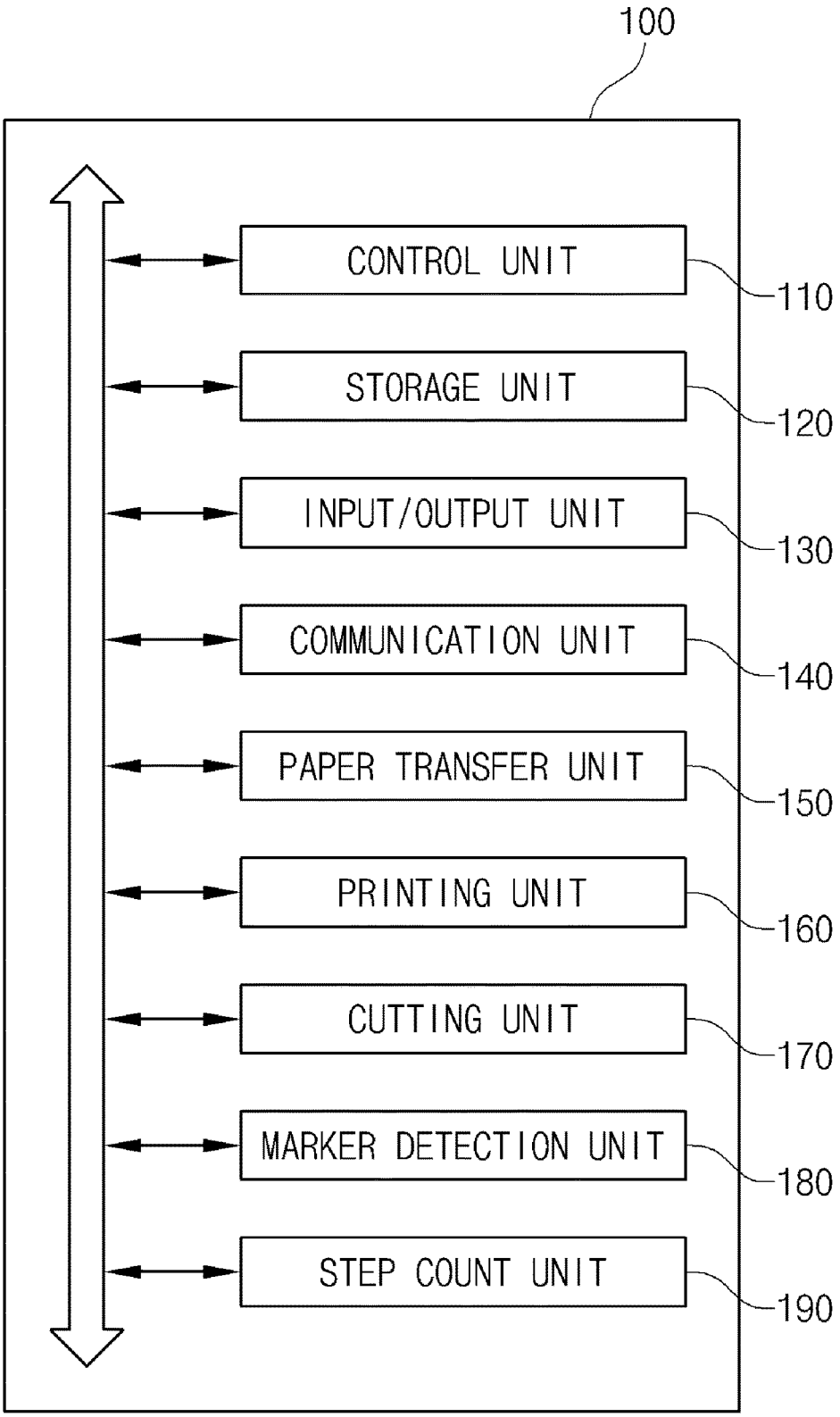
FIG. 2 is a block diagram showing the functional configuration of a printer according to one embodiment.
Figure 3:
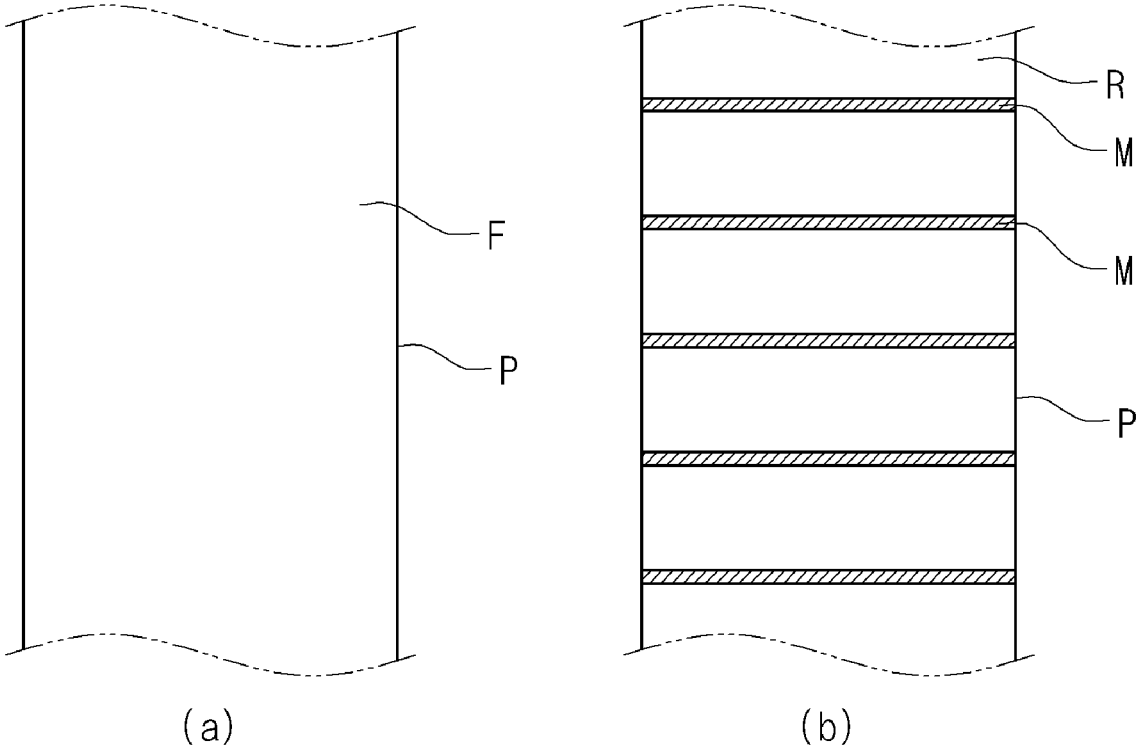
FIG. 3 is a view showing an example of printing paper that is used in a printer according to one embodiment.
Figure 4:
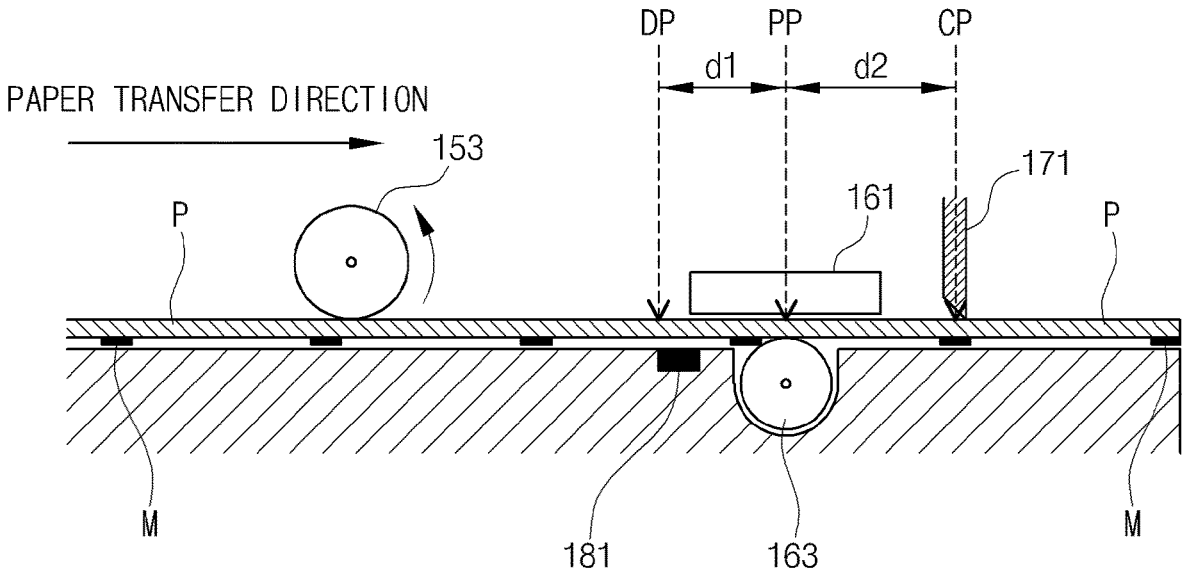
FIG. 4 is a view illustrating a process in which a printer according to one embodiment performs printing on printing paper and cuts the printing paper.

FIG. 1 is a perspective view of a printer according to one embodiment, FIG. 2 is a block diagram showing the functional configuration of a printer according to one embodiment, and FIG. 3 is a view showing an example of printing paper that is used in a printer according to one embodiment. Furthermore, FIG. 4 is a view illustrating a process in which a printer according to one embodiment performs printing on printing paper and cuts the printing paper.

In an embodiment, a printer 100 is a device that performs printing on printing paper by means of at least one of various printing methods. The printer 100 may communicate with another information processing device, may receive printing data, may image the received printing data, and may print the image on a printing medium.

More specifically, referring to FIGS. 1 and 2, the printer 100 may include a control unit 110. The control unit 110 controls the overall operation of the printer 100, and may include a processor, such as a CPU or the like. The control unit 110 may control other components included in the printer 100 so that they perform an operation corresponding to user input received through an input/output unit 130 to be described later or a print command received through a communication unit 140.

For example, the control unit 110 may execute a program stored in a storage unit 120, may read a file or data stored in the storage unit 120, or may at least temporarily store a new file or data in the storage unit 120.

Furthermore, the control unit 110 may perform control such that output is printed on printing paper via a printing unit 160 and a cutting unit 170 cuts the printing paper, on which the output has been printed, at an appropriate location while performing control such that a paper transfer unit 150 to be described later transfers printing paper.

In other words, the control unit 110 performs control such that individual components included in the printer 100 operate normally or checks the operating states of the components while communicating with the components.

Furthermore, the printer 100 may include the storage unit 120. Various types of data, such as various types of files, applications, programs, etc. required for the driving of the printer 100, may be installed and stored in the storage unit 120. The control unit 110 may access and use data stored in the storage unit 120, or may store new data in the storage unit 120. Furthermore, the control unit 110 may execute a program installed in the storage unit 120. Referring to FIG. 2, a program configured to perform a printing method to be described later may be stored in the storage unit 120.

Meanwhile, the printer 100 may include the input/output unit 130. The input/output unit 130 may include an input unit configured to receive input from a user, and an output unit configured to display information, such as the results of the performance of a job, the state of the printer 100, or the like. For example, the input/output unit 130 may include an operation panel configured to receive user input, and a display panel configured to display screens.

More specifically, the input unit may include devices capable of receiving various types of user input, such as a keyboard, physical buttons, a touch screen, a camera, a microphone, etc. Furthermore, the output unit may include a display panel, a speaker, etc. However, the input/output unit 130 is not limited thereto, but may include components configured to support various types of input/output.

Furthermore, the printer 100 may include the communication unit 140. The communication unit 140 may perform wired/wireless communication with another device or a network. For this purpose, the communication unit 140 may include a communication module configured to support at least one of various wired/wireless communication methods. For example, the communication module may be implemented in the form of a chipset.

The wireless communication supported by the communication unit 140 may be, for example, Wireless Fidelity (Wi-Fi), Wi-Fi Direct, Bluetooth, Ultra Wide Band (UWB), Near Field Communication (NFC), or the like. Furthermore, the wired communication supported by the communication unit 140 may be, for example, USB, High Definition Multimedia Interface (HDMI), or the like.

Moreover, the printer 100 may include the paper transfer unit 150. The paper transfer unit 150 at least temporarily accommodates printing paper used by the printer 100 as printing media inside the printer 100, and transfers the printing paper accommodated inside the printer 100 in a predetermined transfer direction. Referring to FIG. 1, the paper transfer unit 150 may be configured to include a holder 151 configured to accommodate printing paper wound in the form of a roll so that the printing paper can be wound or unwound, a roller 153 configured to transfer the printing paper in a transfer direction in such a manner that the unwound front end of the printing paper wound in the form of a roll and the outer circumferential surface of the roller 153 are rotated while being in contact with each other, and a motor (not shown) configured to exert driving force to the roller 153 so that the roller 153 can be rotated.

Accordingly, when the motor is rotated, the roller 153 connected to the motor is rotated, and thus the printing paper may be unwound from the roll and then transferred in the transfer direction.

In this case, the paper transfer unit 150 does not necessarily transfer printing paper only in the transfer direction, but may transfer printing paper in a reverse direction when required, thereby performing back-feeding.

Meanwhile, the printer 100 includes the printing unit 160. The printing unit 160 is a component configured to print output intended for printing, i.e., output target data, in the shape of an image or letters that can be perceived by the eyes of a human on one surface of printing paper. The printing unit 160 may be implemented as another component according to the printing method of the printer 100. Although the printing unit 160 may include a thermosensitive print head 161 in an example shown in FIG. 1, this is merely an embodiment, and the printing method of the printer 100 is not limited to a specific method in the present specification.

Furthermore, a configuration may be made such that the printing unit 160 includes the print roller 163 on one side opposite to the print head 161 and thus printing is performed on printing paper when the printing paper passes between the print head 161 and the print roller 163.

Moreover, the printer 100 may include the cutting unit 170. The cutting unit 170 is a component configured to cut printing paper, and may automatically or manually cut printing paper. For example, when the cutting unit 170 is configured to include only a cutter blade 171, as shown in FIG. 1, a user may manually cut printing paper by moving the printing paper in the direction of the cutter blade 171 so that the printing paper is cut by the cutter blade 171. In this case, the position at which the printing paper is cut by the cutter blade 171 of the cutting unit 170 will be referred to as a "cutting position." As still another embodiment, the cutting unit 170 may automatically cut printing paper. For example, the cutting unit 170 includes a moving blade (not shown) and a fixed blade (not shown) formed opposite to the moving blade. Printing paper located between the moving blade and the fixed blade is cut in such a manner that the moving blade is selectively moved toward the fixed blade.

In this case, the above-described paper transfer unit 150 may transfer printing paper so that the portion of the printing paper to be cut can be located at the cutting position.

Meanwhile, a printer 100 according to one embodiment may include a marker detection unit 180. The marker detection unit 180 includes a sensor 181 configured to recognize markers arranged on printing paper.

In this case, the configurations of printing paper and markers arranged on the printing paper will be described in greater detail. As shown in FIG. 3, printing paper P includes a front surface F on which output will be printed, and a rear surface R which is a surface opposite to the front surface F. In this case, an adhesive may be applied to the rear surface R of the printing paper P, and release paper (not shown) configured to protect the applied adhesive may be attached onto the rear surface R.

In this case, a plurality of markers M may be repeatedly arranged on the rear surface R of the printing paper P. In this case, when release paper is attached to the rear surface R of the printing paper P, markers M may be arranged on one surface of the release paper, i.e., a surface opposite to the surface of the printing paper P to which the release paper is attached, in place of the rear surface R.

In this case, the markers M may be any type of markers that enable the locations at which the markers M are disposed and the locations at which the markers M are not disposed to be optically identified based on the direction in which the printing paper P is transferred. In particular, the markers M are used to identify the locations of vertical components with respect to the transfer direction of the printing paper P, and may be formed as rectilinear lines perpendicular to the transfer direction of the printing paper P, as shown in FIG. 3. However, although the markers M are illustrated as being arranged in the shape of rectilinear lines extending throughout the overall width of the printing paper P in FIG. 3, the markers M are not necessarily limited thereto, but may be formed in a different manner, as in a case where the markers M are formed in the shape of line segments extending across part of the width of the printing paper P.

Furthermore, the markers M may be formed by applying or printing a component having a different color or a different reflectance for light of a specific wavelength with respect to the rear surface R of the printing paper P on which the markers M are arranged or one surface of release paper onto the printing paper P.

Meanwhile, as described above, the plurality of markers M may be repeatedly formed. In particular, they may be formed at predetermined intervals. In this case, the term "predetermined intervals" does not mean that the intervals at which all the markers M are arranged are unified into a single predetermined interval, but means that some of the markers M are arranged in different intervals and groups of the markers M arranged in the different intervals periodically appear throughout the overall printing paper P in an embodiment.

Moreover, the markers M may be divided into two or more different types. Accordingly, the above-described marker detection unit 180 may distinguish and recognize different types of markers M. In this case, different types of markers M may be used to indicate different intervals with neighboring markers M. For example, in the case where markers M are arranged to alternately have first and second intervals, the interval at which a recognized marker M and its neighboring marker M are arranged may be estimated by alternately showing first and second markers M.

Meanwhile, the sensor 181 of the marker detection unit 180 is a means for optically recognize the markers M arranged on the printing paper P. The sensor 181 may be configured to transmit a specific signal to the control unit 110 when recognizing each of the markers M.

Moreover, the printer 100 according to one embodiment may include a step count unit 190. The step count unit 190 may count the number of steps of the motor included in the above-described paper transfer unit 150. As an example, the step count unit 190 may be configured to include an encoder configured to detect the RPM of the motor.

In this case, the control unit 110 may convert the number of steps of the motor counted by the step count unit 190 into the transfer distance of the printing paper P. Alternatively, the control unit 110 may convert the transfer distance of paper into the number of steps of the motor, and may perform various types of operations to be described later.

Meanwhile, the arrangement of the components of the printer 100 will be described based on the transfer direction of the printing paper P more specifically, which is shown in FIG. 4. As shown in the drawing, the printing paper P is transferred in the paper transfer direction by the rotation of the transfer roller 153. In this case, first, the sensor 181 may be located on the rear surface (R) side of the printing paper P based on the transfer direction of the printing paper P. Thereafter, the print head 161 may be located opposite to the front surface of printing paper P, and then the cutter blade 171 may be located behind the print head 161. In this case, when in connection with the paper transfer direction, the location at which the sensor 181 is disposed to detect the markers M is referred to as a detection position DP, the location at which the print head 161 performs printing on the printing paper P is referred to as a printing position PP, and the location at which the printing paper P is cut by the cutter blade is referred to as a cutting position CP, the detection position DP, the printing position PP, and the cutting position CP may be sequentially arranged, as shown in FIG. 4.

However, the foregoing is not true in all embodiments. In an embodiment, the detection position DP may be disposed between the printing position PP and the cutting position CP. In other words, the sensor 181 of the marker detection unit 180 may be disposed between the print head 161 and the cutter blade 171.

Meanwhile, in the printer 100 according to one embodiment, the operation of the above-described control unit 110 will be described in greater detail. The control unit 110 performs control such that when printing unit 160 prints a single unit output on printing paper, the paper transfer unit 150 transfers the printing paper until a marker first disposed after the location at which the printing of the unit output has been completed based on the transfer direction of the printing paper, i.e., a cutting target marker, reaches the cutting position of the cutting unit 170. In other words, the control unit 110 sets a marker, disposed immediately next to the location at which the printing of the unit output has been completed based on the transfer direction of the printing paper, as the cutting target marker, and transfers the printing paper so that the cutting target marker reaches a cutting position before the cutting of the printing paper. Furthermore, the control unit 110 may perform control such that the cutting unit 170 cuts printing paper after the cutting target marker has reached the cutting position.

In this case, as one embodiment, the control unit 110 may calculate a transfer target distance, over which the paper transfer unit 150 will transfer printing paper, from the time at which the printing of the unit output has been completed by the printing unit 160 based on the location of the marker detected by the marker detection unit 180 in order to transfer the printing paper until the cutting target marker reaches the cutting position. In this case, the transfer target distance of the printing paper is the distance over which the printing paper will be transferred in the transfer direction at the time at which the printing of a unit output has been completed. In other words, the transfer target distance of the printing paper is the distance over which the printing paper needs to be transferred so that the cutting target marker first disposed after the location at which the printing of the printing paper on which the unit output has been printed has been completed reaches the cutting unit.

In order to calculate the transfer target distance, the control unit 110 may count or calculate at least one of the transfer distance of the printing paper and the number of steps of the motor, and may use the results of the counting or calculation for the calculation of the transfer target distance. More specifically, the control unit 110 may count the transfer distance over which the paper transfer unit 150 has transferred printing paper while the printing unit 160 is printing a unit output, and may initialize the counted transfer distance when the marker detection unit 18 detects a marker before the printing unit 150 completes the printing of the unit output. The control unit 110 may recount the initialized transfer distance when the marker is detected during printing, and may calculate the transfer target distance by using the transfer distance counted up to now when the printing unit 160 completes the printing of the unit output. In this case, the transfer distance and the transfer target distance may be calculated as the numbers of steps of the motor, and may be calculated as actual distance units. In other words, the control unit 110 may count the transfer distance based on the number of steps of the motor counted by the step count unit 190, may count the number of steps of the motor while initializing the counted number of steps of the motor when the marker detection unit 180 detects a marker, and may use the counted number of steps of the motor without change or may convert the counted number of steps of the motor into the transfer distance and use the transfer distance.

In this case, to calculate the transfer target distance, the control unit 110 may calculate the transfer target distance by subtracting the counted transfer distance from a preset fixed value. The preset fixed value may vary depending on an embodiment. In this case, the fixed value may be determined based on the distance between the detection position DP and the cutting position CP in an embodiment, such as that shown in FIG. 4. Furthermore, in some cases, the fixed value may be determined based on both the distance between the detection position DP and the cutting position CP and the interval between the markers. In this case, even when the detection position DP is disposed between the printing position PP and the cutting position CP, the fixed value may vary depending on the distance between the detection position DP and the cutting position CP, and may also vary depending on the interval between the markers. In this case, the transfer target distance may be calculated by subtraction from the fixed value.

Moreover, in another embodiment, the control unit 110 may cause the marker detection unit 180 to start to detect a marker from the time at which the printing unit 160 starts to print a unit output to the time at which a first transfer distance over which the paper transfer unit 150 has transferred printing paper reaches a value obtained by subtracting a preset first predetermined distance from the expected printing length of a unit output, and may cause the paper transfer unit 150 to transfer the printing paper from the time at which the marker detection unit 180 detects a marker to the time at which a second transfer distance over which the paper transfer unit 150 has transferred the printing paper reaches a preset second predetermined distance.

In the other embodiment, before the first transfer distance reaches a value obtained by subtracting the first predetermined distance from the expected printing length of the unit output, the control unit 110 may ignore recognition even when the marker detection unit 180 recognizes a marker or may block the marker detection unit 180 from starting to detect a marker.

In this case, the first predetermined distance may be set to a distance corresponding to the distance between the detection position DP and the printing position PP in advance, and the second predetermined distance may be set to a distance corresponding to the distance between the detection position DP and the cutting position CP in advance. In this case, the detection position DP, the printing position PP, and the cutting position CP may be sequentially arranged.

In other words, the control unit 110 may perform control such that only printing is performed without a detecting a marker before the transfer distance of printing paper reaches a value obtained by subtracting the first predetermined distance from an expected printing length, and such that, when a first marker is recognized after the detection of a marker has started because the transfer distance of the printing paper reaches the value obtained by subtracting the first predetermined distance from the expected printing length, the printing paper is cut after the printing paper has been transferred from the location, at which the corresponding marker is recognized, by the distance between the sensor 161 and the cutter 181, i.e., the distance (d1+d2) from the detection position DP to the cutting position CP in FIG. 4.

In this case, to count the first transfer distance and the second transfer distance, the control unit 110 may count and use the number of steps of the motor, as described above. Furthermore, from the time at which a marker starts to be recognized after the detection of a marker has started, the control unit 110 may initialize and recount the number of steps of the motor in order to count the second transfer distance.

Meanwhile, in the other embodiment, in the case where the arrangement of the detection position DP, the printing position PP, and the cutting position CP is changed into the sequence of the printing position PP, the detection position DP, and the cutting position CP, the control unit 110 may cause the detection of a marker to start when the first transfer distance reaches a distance obtained by increasing the expected printing length of the unit output by the distance between the printing position PP and the detection position DP, and may cause the printing paper to be transferred until the second transfer distance counted from the time at which a marker is detected reaches the distance between the detection position DP and the cutting position CP, unlike in the above-described case.

In other words, the above other embodiment may be divided into two embodiments in that in the case where the printing position PP, the detection position DP, and the cutting position CP are sequentially arranged, the control unit 110 causes a marker to be detected after a value obtained by increasing the expected printing length by the first predetermined distance has been reached.

In this case, the expected printing length may be calculated in advance by converting the unit output, i.e., printing data to be printed at a time, into a data type that can be printed by the control unit 110.

Moreover, the control unit 110 may cause the paper transfer unit 150 to transfer the printing paper by a preset back-feeding distance in a direction reverse to the transfer direction before the starting of the printing of a subsequent unit output after the transfer and cutting of the printing paper on which a unit output has been printed have been completed.

In this case, the back-feeding distance may correspond to the distance from the cutting position CP to the printing position PP.

Accordingly, the waste of printing paper may be reduced, and the printing of a subsequent unit output may be restarted from the location at which the above-described cutting target marker is cut.

The printing method of the printer 100 according to one embodiment will be described below with reference to FIGS. 5 and 6.

Figure 5:
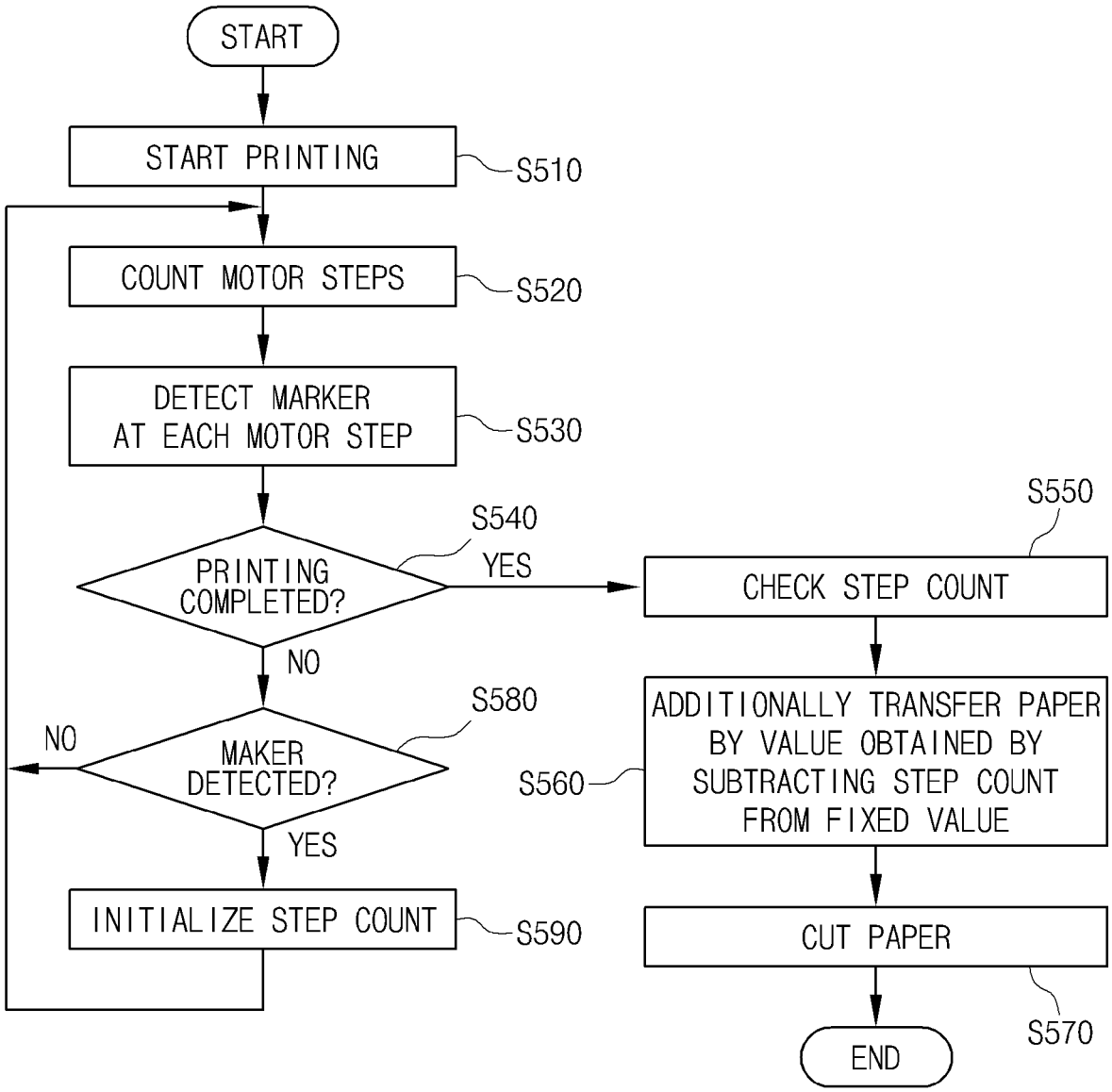
FIGS. 5 to 6 are flowcharts showing a printing method according to one embodiment in a stepwise manner.
Figure 6:
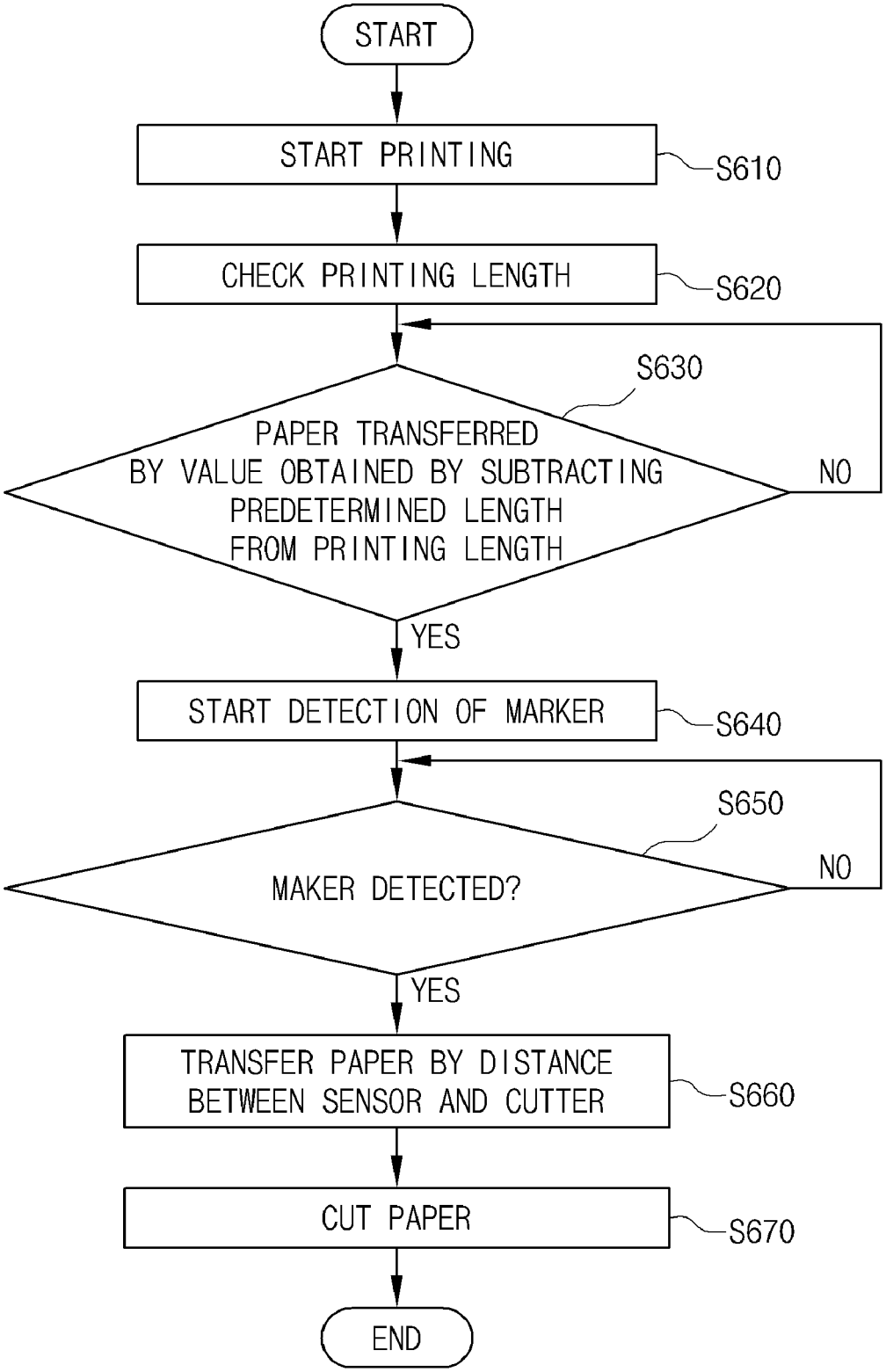

In this case, the printing method according to the embodiment shown in FIGS. 5 and 6 includes the steps that are processed in a time series manner in the printer 100 shown in FIGS. 1 and 2. Accordingly, items which are omitted in the following description but have been described in conjunction with the printer 100 shown in FIGS. 1 and 2 may be also applied to the printing method according to the embodiment shown in FIGS. 5 and 6.

First, in the embodiment shown in FIG. 5, when the printing of one unit output starts to be performed on printing paper at step S510, the printer 100 may perform the step of counting a transfer distance over which the printing paper has been transferred while printing the unit output. For this purpose, the printer 100 may count the number of steps of the motor at step S520. Furthermore, the printer 100 may detect a marker arranged on the printing paper at each step of the motor at step S530.

In parallel with the transfer and printing of the printing paper, counting of the number of steps of the motor and detection of the markers of the printer 100, the printer 100 performs step S540 of determining whether printing has been terminated, step S550 of checking the counted transfer distance or the counted number of steps of the motor when the printing of the unit output has been completed, and step S560 of calculating the transfer target distance of the printing paper, i.e., a value obtained by subtracting the transfer distance from a preset fixed value, and additionally transferring the printing paper by the calculated transfer target distance. Thereafter, the printer 100 may cut the printing paper at step S570.

Meanwhile, when a marker arranged on the printing paper is detected while the printer 100 is printing the unit output, the printer 100 may initialize the counted transfer distance or the counted number of steps of the motor, and may recount the transfer distance or the number of steps of the motor.

Furthermore, the process of initializing and recounting the number of steps of the motor or the transfer distance is repeated whenever a marker is detected during continuous printing. After the printing has been completed, the printing paper may be additionally transferred based on the number of steps of the motor or transfer distance counted at the time at which the printing has been completed, and then the printing paper may be cut.

According to the foregoing, a distance over which a marker first disposed after a location at which the printing has been substantially completed, i.e., a cutting target marker, reaches the cutting position CP, which is the transfer target distance, may be calculated with reference to a transfer distance initialized and recounted whenever a marker is detected and the distance between the detection position DP and the cutting position CP. In this case, the fixed value used for the calculation of the transfer target distance may be determined by additionally taking into account the interval between markers, as described above.

Meanwhile, in another embodiment, the printer 100 may initiate the printing of a unit output at step S610, and may determine the expected printing length of the unit output at step S620, as shown in FIG. 6.

In this case, at step S630, the printer 100 may transfer the paper while counting a first transfer distance, i.e., a transfer distance over which the printing paper has been transferred during the printing of the unit output and checking whether the first transfer distance has reached a value obtained by subtracting a preset first predetermined distance from the expected printing length determined at step S620. In this case, to count the first transfer distance, the printer 100 may count the number of steps of the motor in the same manner as in the embodiment shown in FIG. 5, and may count the transfer distance as the number of steps of the motor or use it for operation.

Meanwhile, at step S640, the printer 100 may start to detect a marker when the first transfer distance reaches a value obtained by subtracting the first predetermined distance, i.e., the distance between the detection position CP and the printing position PP, from the expected printing length. It will be apparent that in one embodiment, the printer 100 may not start to detect a marker until the first transfer distance reaches a distance obtained by adding the first predetermined distance and the expected printing length to each other, as described above.

Furthermore, when a marker arranged on the printing paper is detected at step S650 after the starting of the detection of a marker, the printer 100 may initialize the counted transfer distance, may recount the transfer distance or the number of steps of the motor, and may count a second transfer distance.

Thereafter, the printer 100 may transfer the printing paper at step S660 until the second transfer distance the counting of which started when the marker was detected reaches the distance between the detection position DP and the cutting position CP, i.e., the distance between the sensor 161 and the cutter blade 181 shown in FIG. 4, and may cause the paper to be cut at step S670.

According to this method, a marker first disposed after the time at which the printing of a unit output has been completed is transferred up to the cutting position CP, so that the portion where the marker is located is accurately cut, and also the printing area of the unit output is prevented from being erroneously cut.

The term "unit" used in the above-described embodiments refers to a software component or a hardware component, such as a field programmable gate array (FPGA) or application specific integrated circuit (ASIC), and a unit performs a specific task. However, the term "unit" is not limited to a software component or a hardware component. A unit may be configured to reside on an addressable storage medium, and may be configured to be executed on one or more processors. Accordingly, a unit may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables.

The functions provided in components and units may be combined into a smaller number of components and units, or may be separated into additional components and units.

Furthermore, components and units may be configured to be executed on one or more central processing units (CPUs) inside a device or security multimedia card.

The printing methods according to the embodiments described in conjunction with FIGS. 5 and 6 may be each implemented in the form of a computer-readable medium that stores instructions and data that can be executed by a computer. In this case, the instructions and the data may be stored in the form of program code, and may generate a predetermined program module and perform a predetermined operation when executed by a processor. Furthermore, the computer-readable medium may be any type of available medium that can be accessed by a computer, and may include volatile, non-volatile, separable and non-separable media. Furthermore, the computer-readable medium may be a computer storage medium. The computer storage medium may include all volatile, non-volatile, separable and non-separable media that store information, such as computer-readable instructions, a data structure, a program module, or other data, and that are implemented using any method or technology. For example, the computer storage medium may be a magnetic storage medium such as an HDD, an SSD, or the like, an optical storage medium such as a CD, a DVD, a Blu-ray disk or the like, or memory included in a server that can be accessed over a network.

Furthermore, the printing methods according to the embodiments described in conjunction with FIGS. 5 and 6 may be each implemented as a computer program (or a computer program product) including computer-executable instructions. The computer program includes programmable machine instructions that are processed by a processor, and may be implemented as a high-level programming language, an object-oriented programming language, an assembly language, a machine language, or the like. Furthermore, the computer program may be stored in a tangible computer-readable storage medium (for example, memory, a hard disk, a magnetic/optical medium, a solid-state drive (SSD), or the like).

Accordingly, the printing methods according to the embodiments described in conjunction with FIGS. 5 and 6 may be each implemented in such a way that a computer program, such as that described above, is executed by a computing device. The computing device may include at least part of a processor, memory, a storage device, a high-speed interface accessing the memory and a high-speed expansion port, and a low-speed interface accessing a low-speed bus and a storage device. These components are connected to each other by means of various buses, and may be mounted on a common motherboard or by means of another appropriate method.

In this case, the processor may process instructions in a computing device. For example, these instructions may be instructions that are stored in memory or a storage device and that are used to display graphics information adapted to provide a graphical user interface (GUI) to an external input/output device, for example, a display connected to a high-speed interface. As another embodiment, a plurality of processors and/or a plurality of buses may be appropriately used along with a plurality of pieces of memory and memory forms. Furthermore, the processor may be implemented as a chipset that includes chips including a plurality of independent analog and or digital processors.

Furthermore, the memory stores information in a computing device. For example, the memory may include a volatile memory unit or a set of volatile memory units. As another example, the memory may include a non-volatile memory unit or a set of non-volatile memory units. Furthermore, the memory may be, for example, another type of computer-readable medium, such as a magnetic or optical disk.

Additionally, the storage device may provide a large-sized storage space to a computing device. The storage device may be a computer-readable medium or a configuration including such a medium. For example, the storage device may include devices included in a storage area network (SAN), or may include another component. The storage device may be a floppy disk device, a hard disk device, an optical disk device, a tape device, flash memory, or another semiconductor memory device or device array similar thereto.

The above-described embodiments are merely illustrative, and it will be understood by those having ordinary knowledge in the art to which the present invention pertains that modifications and variations may be easily made without departing from the technical spirit and essential features of the present invention. Therefore, it should be appreciated that the above-described embodiments are illustrative but are not limitative in all aspects. For example, each component which is described as being configured in a single form may be practiced in a distributed form. In the same manner, components that are described as being configured in a distributed form may be practiced in an integrated form.

The scope of the present invention intended to be protected via the present specification is defined by the attached claims, rather than the foregoing detailed description. Furthermore, all modifications and variations derived from the meanings, scope and equivalents of the claims should be construed as falling within the scope of the present invention.

The invention claimed is:

1. A printer for printing individual unit outputs while transferring printing paper on which a plurality of markers is repeatedly arranged in a transfer direction, the printer comprising:

a printing unit that performs printing on the printing paper;

a paper transfer unit that transfers the printing paper;

a marker detection unit that detects the markers arranged on the printing paper;

a cutting unit that cuts the printing paper at a cutting position; and a control unit that, when the printing unit prints one of the unit outputs on the printing paper, causes the paper transfer unit to transfer the printing paper until a cutting target marker first disposed after a location at which the printing of the unit output has been completed based on a transfer direction of the printing paper reaches a cutting position of the cutting unit.

2. The printer of claim 1, wherein the control unit calculates a transfer target distance over which the paper transfer unit needs to transfer the printing paper from a time at which the printing of the unit output has been completed by the printing unit in order to transfer the printing paper until the cutting target marker reaches the cutting position based on a location of one of the markers that is detected by the marker detection unit.

3. The printer of claim 2, wherein the control unit counts a transfer distance over which the paper transfer unit has transferred the printing paper while the printing unit is printing the unit output, initializes the counted transfer distance and also starts to recount a transfer distance when the marker detection unit detects the marker before the printing unit completes the printing of the unit output, and calculates the transfer target distance by using the counted transfer distance when the printing unit completes the printing of the unit output.

4. The printer of claim 3, wherein:

the paper transfer unit comprises a roller that transfers the printing paper in such a manner that the printing paper and an outer circumferential surface of the roller are rotated while being in contact with each other, and a motor that transfers driving force to the roller;

the printer further comprises a step count unit that counts a number of steps of the motor; and the control unit counts the transfer distance based on the number of steps of the motor counted by the step count unit, and initializes the counted number of steps of the motor when the marker detection unit detects the marker.

5. The printer of claim 3, wherein the control unit calculates the transfer target distance by subtracting the counted transfer distance from a preset fixed value when the printing unit completes the printing of the unit output.

6. The printer of claim 1, wherein the control unit causes the marker detection unit to start to detect one of the markers when a first transfer distance over which the paper transfer unit has transferred the printing paper reaches a value obtained by subtracting a preset first predetermined distance from an expected printing length of the unit output from a time at which the printing unit starts to print the unit output, and causes the paper transfer unit to transfer the printing paper from a time at which the marker detection unit detects the marker to a time at which a second transfer distance over which the paper transfer unit has transferred the printing paper reaches a preset second predetermined distance.

7. The printer of claim 6, wherein:

a detection position at which the marker detection unit detects one of the markers arranged on the printing paper, a printing position at which the printing unit performs printing on the printing paper, and the cutting position are sequentially arranged based on the transfer direction of the printing paper;

the first predetermined distance is a distance corresponding to a distance between the detection position and the printing position; and the second predetermined distance is set to a distance corresponding to a distance between the detection position and the cutting position in advance.

8. The printer of claim 6, wherein:

the paper transfer unit is configured to include a roller configured to transfer the printing paper in such a manner that the printing paper and an outer circumferential surface of the roller are rotated while being in contact with each other, and a motor configured to exert driving force to the roller;

the printer further comprises a step count unit that counts a number of steps of the motor; and the control unit counts the first transfer distance and the second transfer distance based on the number of steps of the motor counted by the step count unit, and initializes the counted number of steps of the motor when the marker detection unit detects one of the markers.

9. The printer of claim 1, wherein the control unit causes the paper transfer unit to transfer the printing paper by a preset back-feeding distance in a direction reverse to the transfer direction after the printing of the one unit output and the cutting have been completed and before printing of a subsequent unit output starts.

10. A printing method that is performed by a printer for printing individual unit outputs while transferring printing paper on which a plurality of markers is repeatedly arranged in a transfer direction, the printing method comprising:

when printing of one of the unit outputs on the printing paper starts, counting a transfer distance over which the printing paper has been transferred during the printing of the unit output;

when one of the markers arranged on the printing paper is detected, initializing the counted transfer distance, and recounting a transfer distance; and when the printing of the unit output has been completed, calculating a transfer target distance of the printing paper based on the counted transfer distance, and transferring the printing paper by the calculated transfer target distance.

11. The printing method of claim 10, wherein:

counting the transfer distance comprises, when the printing of the unit output starts, starting to detect one of the markers arranged on the printing paper; and recounting a transfer distance comprises:

when one of the markers arranged on the printing paper is detected during the printing of the unit output, initializing the counted transfer distance, and recounting a transfer distance; and when the printing of the unit output has been completed, stopping the detection of one of the markers arranged on the printing paper.

12. A printing method that is performed by a printer for printing individual unit outputs while transferring printing paper on which a plurality of markers is repeatedly arranged in a transfer direction, the printing method comprising:

when printing of one of the unit outputs on the printing paper starts, counting a transfer distance over which the printing paper has been transferred during the printing of the unit output;

when the counted transfer distance reaches a value obtained by subtracting a preset first predetermined distance from an expected printing length of the unit output, starting detection of one of the markers arranged on the printing paper;

when one of the markers arranged on the printing paper is detected after the starting of detection of one of the markers, initializing the counted transfer distance, and recounting a transfer distance; and transferring the printing paper until the transfer distance recounted after the initialization reaches a preset second predetermined distance.

13. The printing method of claim 12, wherein:

a detection position at which the marker detection unit detects one of the markers arranged on the printing paper, a printing position at which the printing unit performs printing on the printing paper, and the cutting position are sequentially arranged based on the transfer direction of the printing paper;

the first predetermined distance is a distance corresponding to a distance between the detection position and the printing position; and the second predetermined distance is set to a distance corresponding to a distance between the detection position and the cutting position in advance.

14. The printing method of claim 12, further comprising, after transferring the printing paper, cutting the printing paper.

* * * * *